US009074537B2

(12) United States Patent
Wang et al.

(10) Patent No.: US 9,074,537 B2
(45) Date of Patent: Jul. 7, 2015

(54) ADAPTIVE ENGINE SPEED CONTROL TO PREVENT ENGINE FROM ROLL AND STALL

(71) Applicant: GM GLOBAL TECHNOLOGY OPERATIONS LLC, Detroit, MI (US)

(72) Inventors: Wenbo Wang, Novi, MI (US); Thomas C. Pelton, Clarkston, MI (US); Alfred E. Spitza, Jr., Brighton, MI (US); Timothy J. Braman, Williamston, MI (US); Matthew M. Manning, Brighton, MI (US); Krishnendu Kar, South Lyon, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 412 days.

(21) Appl. No.: 13/673,181

(22) Filed: Nov. 9, 2012

(65) Prior Publication Data

US 2014/0136074 A1 May 15, 2014

(51) Int. Cl.
*F02D 41/08* (2006.01)
*F02D 31/00* (2006.01)

(52) U.S. Cl.
CPC ..... *F02D 31/003* (2013.01); *F02D 2250/18* (2013.01); *F02D 2250/22* (2013.01)

(58) Field of Classification Search
CPC ..... F02D 31/003; F02D 2250/22; F02D 2250/18; F02D 41/22
USPC ..... 123/339.1, 339.14, 339.15, 339.19, 123/436; 701/103, 107, 110
See application file for complete search history.

(56) References Cited

U.S. PATENT DOCUMENTS 6,109,236 A * 8/2000 Takahashi et al. ..... 123/339.19
2005/0216165 A1* 9/2005 Ito ..... 701/84

* cited by examiner

*Primary Examiner* — Hai Huynh

(57) ABSTRACT

An adaptive engine speed control system includes an idle condition module that determines whether the engine is idling and determines whether an actual engine speed is different than a desired engine speed. The desired engine speed corresponds to a commanded engine speed. A torque reserve determination module adjusts at least one of a torque reserve and the desired engine speed based on the determination of whether the engine is idling and the determination that the actual engine speed differs from the desired engine speed. The torque reserve corresponds to a quantity of torque reserved to respond to an anticipated future load on the engine.

14 Claims, 4 Drawing Sheets

ADAPTIVE ENGINE SPEED CONTROL TO PREVENT ENGINE FROM ROLL AND STALL

FIELD

The present disclosure relates to preventing engine speed roll and stall in an engine of a vehicle.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An internal combustion engine combusts an air and fuel mixture within engine cylinders to drive pistons and produce drive torque. Air flow into the engine is regulated via a throttle. More specifically, the throttle adjusts throttle area, which increases or decreases air flow into the engine. As the throttle area increases, the air flow into the engine increases. A fuel control system adjusts the rate that fuel is injected to provide a desired air/fuel mixture to the cylinders. Increasing the amount of air and fuel provided to the cylinders increases the output torque of the engine.

SUMMARY

An adaptive engine speed control system includes an idle condition module that determines whether the engine is idling and determines whether an actual engine speed is different than a desired engine speed. The desired engine speed corresponds to a commanded engine speed. A torque reserve determination module adjusts at least one of a torque reserve and the desired engine speed based on the determination of whether the engine is idling and the determination that the actual engine speed differs from the desired engine speed. The torque reserve corresponds to a quantity of torque reserved to respond to an anticipated future load on the engine.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

An engine speed (e.g., actual engine speed) may be controlled according to a desired engine speed. The engine speed may be controlled by adjusting actuator valves (for example only, throttle area, spark, fueling rate, etc.). If an air leak or unmetered airflow into the intake manifold is present (e.g., the air meter is reporting lower air flow than actual), the actual engine speed may decrease and/or increase in an approximate sinusoidal pattern (referred to as engine roll), or the actual engine speed may vary from the desired speed (referred to as engine speed instability). An adaptive engine speed control system and method according to the present disclosure improves the idle engine stability when an air leak or unmetered airflow is present by increasing a torque reserve or a desired engine speed to compensate for the air leak or unmetered airflow to prevent engine roll or instability.

Figure 1:
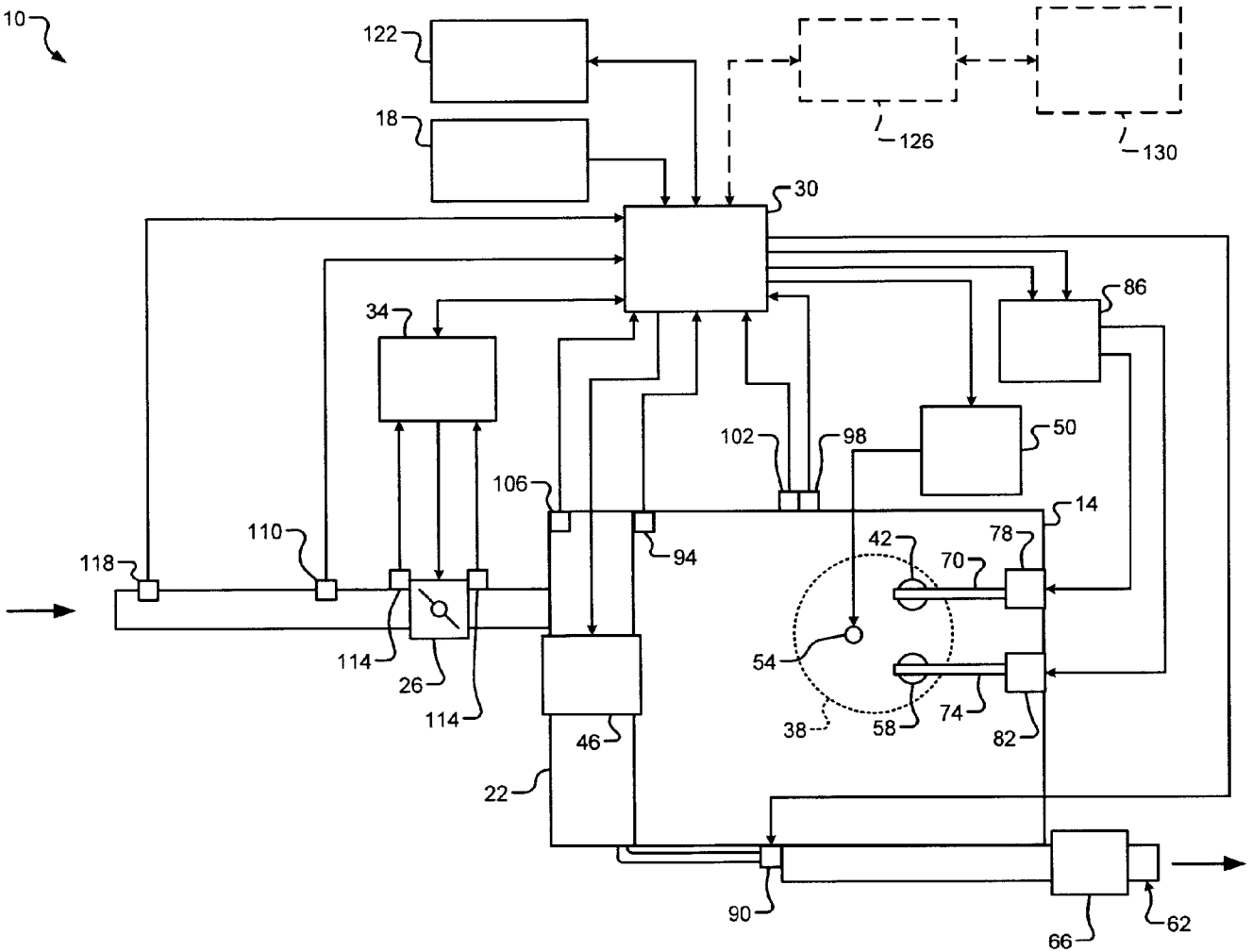
FIG. 1 is a functional block diagram of an engine control system according to the present disclosure.

Referring now to FIG. 1, a functional block diagram of an example adaptive engine speed control system 10 is presented. The adaptive engine speed control system 10 includes an engine 14 that combusts an air/fuel mixture to produce drive torque for a vehicle based on driver input from a driver input module 18. Air may be drawn into an intake manifold 22 through a throttle valve 26. For example only, the throttle valve 26 may include a butterfly valve having a rotatable blade. A control module 30 controls a throttle actuator module 34, which regulates opening of the throttle valve 26 to control the amount of air drawn into the intake manifold 22.

Air from the intake manifold 22 is drawn into cylinders of the engine 14. While the engine 14 may include multiple cylinders, for illustration purposes only, a single representative cylinder 38 is shown. For example only, the engine 14 may include 2, 3, 4, 5, 6, 8, 10, and/or 12 cylinders.

The engine 14 may operate using a four-stroke cylinder cycle or another suitable operating cycle. The four strokes, described below, may be named an intake stroke, a compression stroke, a combustion stroke, and an exhaust stroke. During each revolution of a crankshaft (not shown), two of the four strokes occur within the cylinder 38. Therefore, two crankshaft revolutions are necessary for the cylinder 38 to experience all four of the strokes.

During the intake stroke, air from the intake manifold 22 is drawn into the cylinder 38 through an intake valve 42. The control module 30 controls a fuel actuator module 46, which regulates fuel injection to achieve a desired air/fuel ratio. Fuel may be injected into the intake manifold 22 at a central location or at multiple locations, such as near the intake valve 42 of each of the cylinders. In various implementations (not shown), fuel may be injected directly into the cylinders or into mixing chambers associated with the cylinders.

The injected fuel mixes with air and creates an air/fuel mixture in the cylinder 38. During the compression stroke, a piston (not shown) within the cylinder 38 compresses the air/fuel mixture. Based on a signal from the control module 30, a spark actuator module 50 may energize a spark plug 54 in the cylinder 38, which ignites the air/fuel mixture. The timing of the spark may be specified relative to the time when the piston is at its topmost position, referred to as top dead center (TDC).

The spark actuator module 50 may be controlled by a timing signal specifying how far before or after TDC to generate the spark. Because piston position is directly related to crankshaft rotation, operation of the spark actuator module 50 may be synchronized with crankshaft angle. Generating spark in a cylinder may be referred to as a firing event.

The spark actuator module 50 may have the ability to vary the timing of the spark for each firing event. In addition, the spark actuator module 50 may have the ability to vary the timing of the spark for a given firing event even when a change in the timing signal is received after the firing event immediately before the given firing event.

During the combustion stroke, the combustion of the air/fuel mixture drives the piston down, thereby driving the crankshaft. The combustion stroke may be defined as the time between the piston reaching TDC and the time at which the piston returns to bottom dead center (BDC).

During the exhaust stroke, the piston begins moving up from BDC and expels the byproducts of combustion through an exhaust valve 58. The byproducts of combustion are exhausted from the vehicle via an exhaust system 62. A catalyst 66 receives exhaust gas output by the engine 14 and reacts with various components of the exhaust gas. For example only, the catalyst may include a three-way catalyst (TWC) or another suitable exhaust catalyst.

The intake valve 42 may be controlled by an intake camshaft 70, while the exhaust valve 58 may be controlled by an exhaust camshaft 74. In various implementations, multiple intake camshafts (including the intake camshaft 70) may control multiple intake valves (including the intake valve 42) for the cylinder 38 and/or may control the intake valves (including the intake valve 42) of multiple banks of cylinders (including the cylinder 38). Similarly, multiple exhaust camshafts (including the exhaust camshaft 74) may control multiple exhaust valves for the cylinder 38 and/or may control exhaust valves (including the exhaust valve 58) for multiple banks of cylinders (including the cylinder 38). In various implementations, the intake valve 42 and/or the exhaust valve 58 may be controlled by devices other than camshafts, such as electromagnetic actuators.

The time at which the intake valve 42 is opened may be varied with respect to piston TDC by an intake cam phaser 78. The time at which the exhaust valve 58 is opened may be varied with respect to piston TDC by an exhaust cam phaser 82. A phaser actuator module 86 may control the intake cam phaser 78 and the exhaust cam phaser 82 based on signals from the control module 30. Enablement and disablement of opening of the intake valve 42 and/or the exhaust valve 58 may be regulated in some types of engine systems. Lift and/or duration of opening of the intake valve 42 and/or the exhaust valve 58 may also be regulated in some types of engine systems.

The adaptive engine speed control system 10 may include a boost device (for example, a turbocharger, a supercharger, etc.) that provides pressurized air to the intake manifold 22. A turbocharger (not shown) may include a wastegate (not shown) that controls the amount of exhaust gas allowed to bypass the turbine. The turbocharger may also have variable geometry. An intercooler (not shown) may dissipate some of the heat contained in the compressed air charge, which is generated as the air is compressed. The compressed air charge may also absorb heat from components of the exhaust system 62.

The adaptive engine speed control system 10 may include an exhaust gas recirculation (EGR) valve 90, which selectively redirects exhaust gas back to the intake manifold 22. The EGR valve 90 may be located upstream of the turbocharger's turbine (if present). The EGR valve 90 may be controlled by the control module 30.

The adaptive engine speed control system 10 may measure the rotational speed of the crankshaft (i.e., engine speed) in revolutions per minute (RPM) using a crankshaft position sensor 94. The rotational speed of the crankshaft may be referred to as engine speed. Temperature of engine oil may be measured using an oil temperature (OT) sensor 98. Temperature of engine coolant may be measured using an engine coolant temperature (ECT) sensor 102. The ECT sensor 102 may be located within the engine 14 or at other locations where the coolant is circulated, such as a radiator (not shown).

A pressure within the intake manifold 22 may be measured using a manifold absolute pressure (MAP) sensor 106. In various implementations, engine vacuum, which is the difference between ambient air pressure and the pressure within the intake manifold 22, may be measured. The mass flow rate of air flowing into the intake manifold 22 may be measured using a mass air flowrate (MAF) sensor 110. In various implementations, the MAF sensor 110 may be located in a housing that also includes the throttle valve 26.

The throttle actuator module 34 may monitor the position of the throttle valve 26 using one or more throttle position sensors (TPS) 114. The ambient temperature of air being drawn into the engine 14 may be measured using an intake air temperature (IAT) sensor 118. The control module 30 may use signals from one or more of the sensors to make control decisions for the adaptive engine speed control system 10.

The control module 30 may communicate with a transmission control module 122 to coordinate operation of the engine 14 and a transmission (not shown). The control module 30 may also communicate with a hybrid control module 126, for example, to coordinate operation of the engine 14 and an electric motor 130.

The electric motor 130 may also function as a generator and may be used to produce electrical energy for use by vehicle electrical systems and/or for storage in an energy storage device (e.g., a battery). The production of electrical energy may be referred to as regenerative braking. The electric motor 130 may apply a braking (i.e., negative) torque on the engine 14 to perform regenerative braking and produce electrical energy. The adaptive engine speed control system 10 may also include one or more additional electric motors. In various implementations, various functions of the control module 30, the transmission control module 122, and the hybrid control module 126 may be integrated into one or more modules.

Each system that varies an engine parameter may be referred to as an engine actuator. Each engine actuator receives an associated actuator value. For example, the throttle actuator module 34 may be referred to as an engine actuator and the throttle opening area may be referred to as the associated actuator value. In the example of FIG. 1, the throttle actuator module 34 achieves the throttle opening area by adjusting an angle of the blade of the throttle valve 26.

The spark actuator module 50 may similarly be referred to as an engine actuator, while the associated actuator value may be the amount of spark advance relative to cylinder TDC position. Other actuators may include the fuel actuator module 46 and the phaser actuator module 86. For these engine actuators, the associated actuator values may include fueling rate and intake and exhaust cam phaser angles, respectively. The control module 30 may control actuator values in order to cause the engine 14 to achieve a target engine output torque.

The control module 30 may implement the adaptive engine speed control system according to the present disclosure. The control module 30 communicates with the driver input module 18, the throttle actuator module 34, the fuel actuator module 46, the spark actuator module 50, the phaser actuator module 86, the transmission control module 122 and various sensors 118, 110, 106, 94, 102, 98 to determine whether an air leak or unmetered airflow is present. If an air leak or unmetered airflow is present, the control module 30 implements the adaptive engine speed control system according to the present disclosure to prevent the generally resulting idle instability or engine roll.

Figure 2:
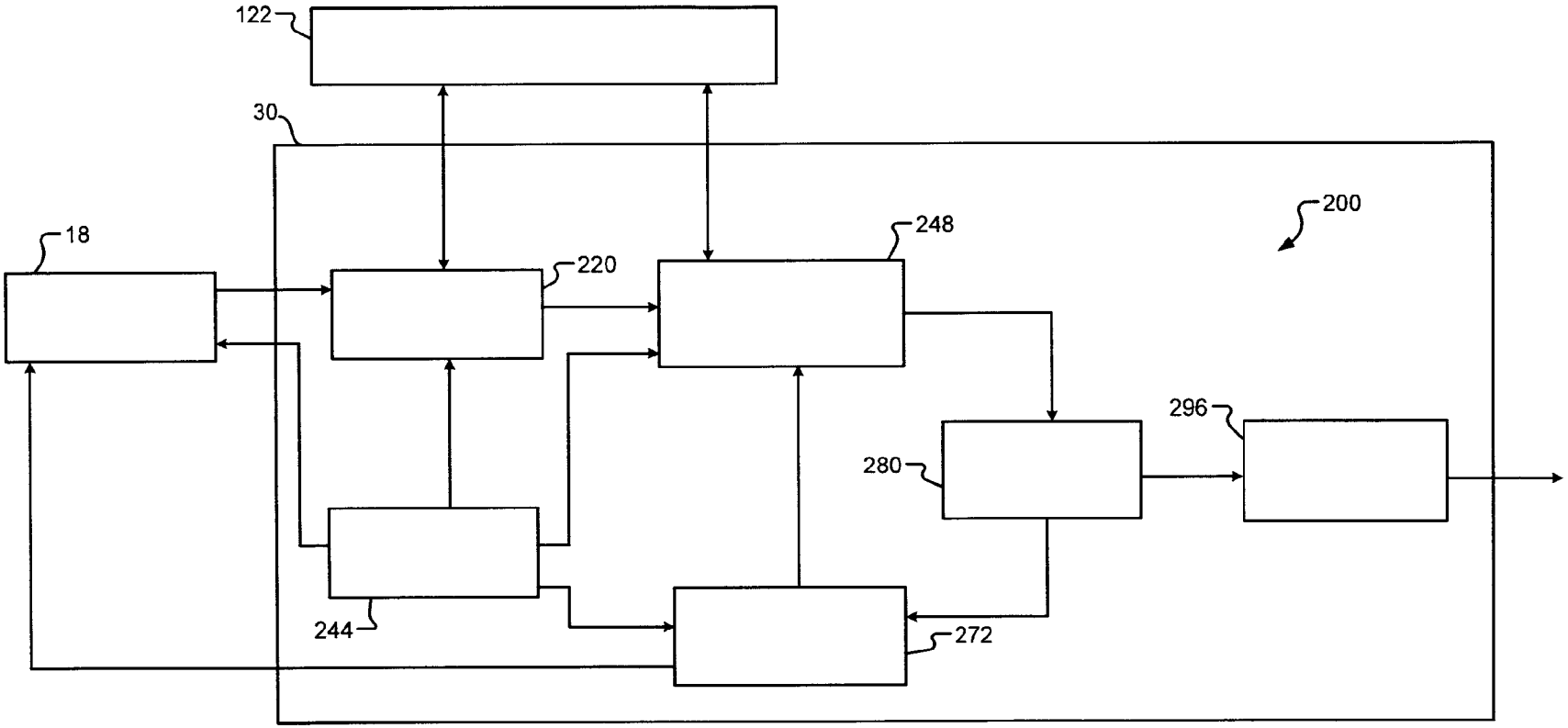
FIG. 2 is a detailed block diagram of the engine control system according to the present disclosure.

Referring now to FIG. 2, a detailed block diagram of an adaptive engine speed control system 200 according to the present disclosure is presented. Not all of the modules illustrated may be incorporated into a system. An exemplary implementation of the control module 30 includes the driver input module 18 from FIG. 1. The driver input module 18 may receive various inputs that may include a cruise control or an active cruise input, a power take off input, a vehicle speed limiter input, or an accelerator pedal sensor input. The driver input module 18 arbitrates between the various inputs and generates a driver axle torque request.

An axle torque arbitration module 220 is in communication with the driver input module 18. The axle torque arbitration module 220 arbitrates between a driver axle torque from the driver input module 18 and other axle torque requests. For example, the axle torque request may include a request for traction/drag control, vehicle over speed protection, brake torque management, requested torque from the transmission, and torque cut-off ring/deceleration fuel cutoff.

Both the driver input module 18 and the axle torque determination module 220 may receive an input from an engine capabilities module 244. The engine capabilities module 244 may provide the engine capabilities corresponding to the engine combustion and hardware limitations.

Torque requests may include target torque values as well as ramp requests, such as a request to ramp torque down to a minimum engine off torque or to ramp torque up from the minimum engine off torque. Axle torque requests may further include engine shutoff requests, such as may be generated when a critical fault is detected.

The axle torque arbitration module 220 outputs an axle predicted torque and an axle immediate torque based on the results of arbitrating between the received torque requests. The axle predicted torque is the amount of torque that the control module 30 requests the engine 14 to generate (for example, the control module 30 sends various commands to actuators to produce the requested torque), and may often be based on the driver's torque request. The axle immediate torque is the amount of currently desired torque, which may be less than the predicted torque.

The immediate torque may be less than the predicted torque to provide torque reserves and to meet temporary torque reductions. The immediate torque may be achieved by varying engine actuators that respond quickly, while slower engine actuators may be used to prepare for the predicted torque. For example, in a gas engine, spark advance may be adjusted quickly, while air flow and cam phaser position may be slower to respond because of mechanical lag time.

The difference between the predicted and immediate torques may be called the torque reserve. When a torque reserve is present, the engine torque can be quickly increased from the immediate torque to the predicted torque by changing a faster actuator. The predicted torque is thereby achieved without waiting for a change in torque to result from an adjustment of one of the slower actuators.

The axle torque arbitration module 220 may convert the axle torque requests to crankshaft torque requests. The crankshaft torque refers to the torque output at the shaft of the engine and is measured at the input to the transmission. The axle torque arbitration module 220 may output the predicted and immediate crankshaft torque to a propulsion torque arbitration module 248.

The propulsion torque arbitration module 248 arbitrates between crankshaft torque requests and generates an arbitrated predicted crankshaft torque and an arbitrated immediate crankshaft torque. The arbitrated torques may be generated by selecting a winning request or by modifying one of the received requests based on one or more others of the received requests.

Other crankshaft torque requests provided to the propulsion torque arbitration module 248 may include a transmission torque request, a torque reduction request, a clutch fuel cutoff request (reduce engine torque output when the driver depresses the clutch pedal in a manual transmission vehicle), an oxygen sensor service request, an engine shutoff request (when a critical fault is detected), and a system remedial action request. An engine shutoff request may always win arbitration, thereby being output as the arbitrated torques, or may bypass arbitration altogether, simply shutting down the engine. For example only, critical faults may include detection of vehicle theft, a stuck starter motor, electronic throttle control problems, and unexpected torque increases.

An RPM control module 272 may also output predicted and immediate torque requests. The predicted torque is a leading request for a slow actuator and an immediate torque is for fast actuators. Fast actuators can act on the predicted request, but it is done so in a fuel economy optimized fashion and with a filtered manifold-like response. The requests are communicated to the propulsion torque arbitration module 248. The torque requests from the RPM control module 272 may prevail in arbitration when the control module 30 is in an RPM mode. The RPM mode may be selected when the driver releases the accelerator pedal, such as when the vehicle is idling or coasting down from a higher speed. Alternatively or additionally, the RPM mode may be selected when the predicted torque requested by the axle torque arbitration module 220 is less than a calibratable torque value.

The RPM control module 272 receives or determines a desired RPM and controls the predicted and immediate torque requests to reduce the difference between the desired RPM and the actual RPM. For example only, a linearly decreasing desired RPM for vehicle coast down may be provided until an idle RPM is reached. Thereafter, the idle RPM may correspond to the desired RPM.

The RPM control module 272 implements the adaptive engine speed control system when the engine is in the RPM mode. The RPM control module 272 receives driver torque requests from the driver input module 18, engine capabilities from the engine capabilities module 244, and maximum predicted torque from a reserves/loads module 280. The RPM control module 272 determines whether an air leak or unmetered airflow is present and determines predicted and immediate torque requests to prevent engine roll or idle instability. The RPM control module 272 communicates the predicted and immediate torque requests to the propulsion torque arbitration module 248. The predicted and immediate torque requests from the RPM control module 272 for the adaptive engine speed control system generally win arbitration in the propulsion torque arbitration module 248. The implementation of the adaptive engine speed control system within the RPM control module 272 will be discussed in further detail with respect to FIG. 3.

The reserves/loads module 280 receives the torque request from the propulsion torque arbitration module 248. Various engine operating conditions may affect the engine torque output. In response to these conditions, the reserves/loads module 280 may create a torque reserve by increasing the predicted torque request. The reserves/loads module 280 may also create a reserve in anticipation of a future load, such as the engagement of the air conditioning compressor clutch or power steering pump operation.

A torque actuation module 296 receives the torque requests from the reserves/loads module 280. The torque actuation module 296 determines how the torque requests will be achieved. The torque actuation module 296 may be engine type specific, with different control schemes for gas engines versus diesel engines. The torque actuation module 296 may open or close the throttle valve, deactivate cylinders, advance or retard spark, and increase or decrease fuel to achieve torque requests.

Figure 3:
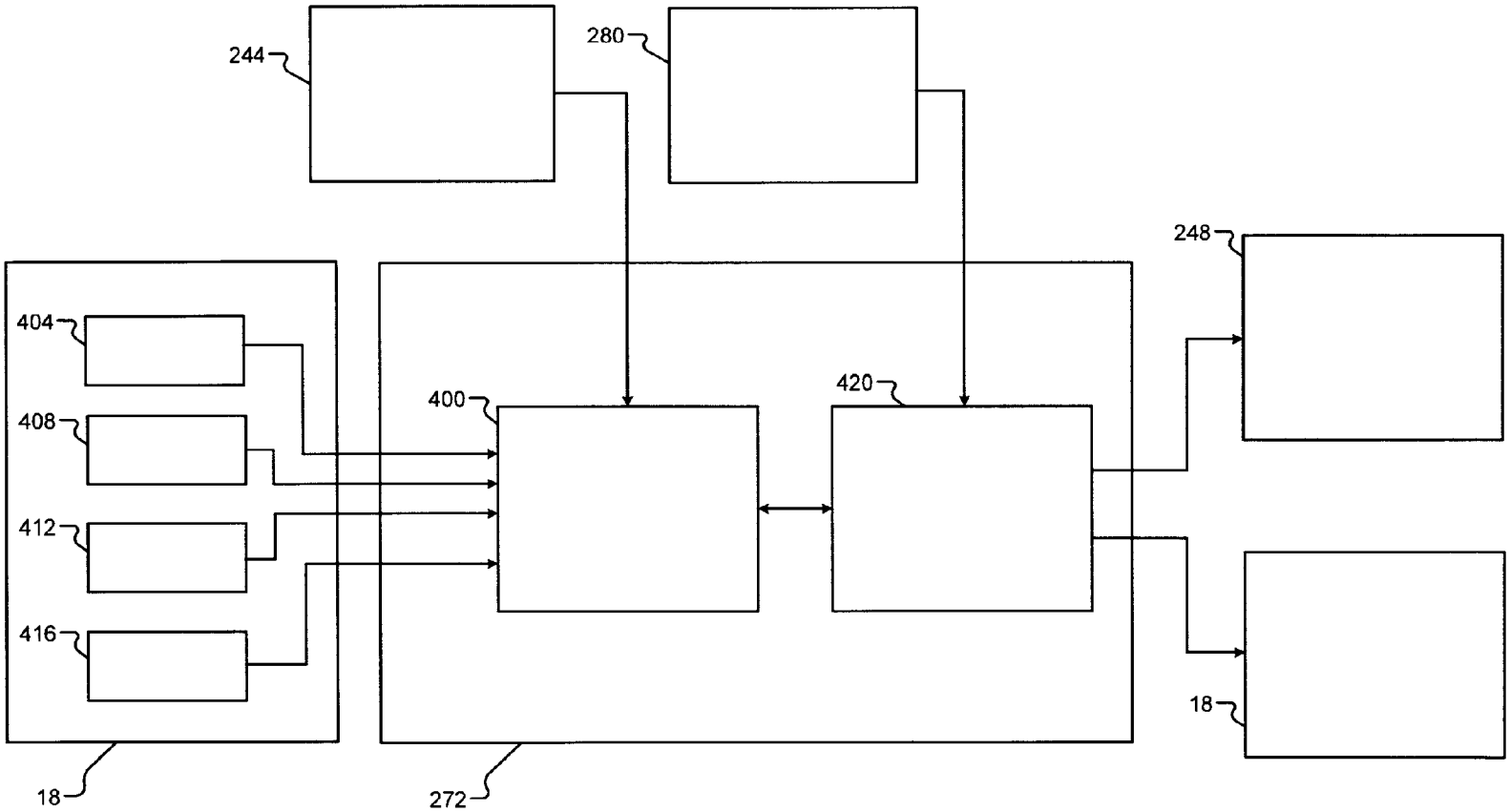
FIG. 3 is a detailed block diagram of a portion of the engine control system according to the present disclosure.

Referring now to FIG. 3, a detailed block diagram of a portion of the adaptive engine speed control system to prevent engine speed (RPM) roll and stall is presented. An idle condition module 400 may be located within the RPM control module 272 and receives driver input characteristic signals from the driver input module 18. For example, the signals may be at least one of engine speed 404, vehicle speed 408, pedal position 412, and throttle position 416. The idle condition module 400 also receives the signals from the engine capabilities module 244. The idle condition module 400 determines whether the engine is in an idle state, whether any lean diagnostic codes have been set, and whether engine roll or idle instability exists. The idle condition module 400 sends signals conveying this information to a torque reserve determination module 420.

The idle condition module 400 determines whether the engine is in an idle state. The engine is idling when at least one of a predetermined list of conditions is met. For example, the engine may be in an idle state if at least one of the pedal position is less than a predetermined pedal threshold (for example only, 2%), the engine speed is less than a predetermined engine speed threshold (for example only, 1000 rpm), the vehicle speed is less than a predetermined vehicle speed threshold (for example only 1 mile/hour (mph) or 1-2 kilometers/hour (kph)), and the throttle position is less than a predetermined throttle position threshold (for example only, in a range of 0-100% area), is true.

The idle condition module 400 interprets diagnostic trouble codes (DTCs) relating to an idle condition. For example only, the idle condition module 400 will determine whether any "lean" codes have been set. Lean codes refer to a condition where more air is entering the engine than is measured by the MAF sensor 110. The control module will enable the lean diagnostic code if an error occurs for a predetermined number of failure counts during a predetermined time period.

The idle condition module 400 determines whether idle instability (engine speed (RPM) instability) or engine roll exists. Idle instability occurs when the actual engine speed becomes a predetermined distance away (error) from the desired engine speed for a predetermined number of failure counts within a predetermined period of time. For example, if the actual engine speed is at least 30 rpm greater than or less than the desired engine speed (for example only, 550 rpm) for at least 5 failure counts within 5 seconds, the engine is experiencing a period of idle instability. Engine roll occurs when the actual engine speed oscillates in a generally sinusoidal wave around the desired engine speed. Engine roll can be determined by calculating an engine roll score for the engine speed during the idle condition. The engine roll score consists of a frequency and an RPM error. The RPM error is a calculated difference between the desired engine speed (RPM) and the actual engine speed (RPM). The frequency is determined by the number of times the actual RPM error occurs and toggles (positive error vs negative error) within a period of time. If the magnitude (rpm error) is greater than a predetermined error threshold (for example only, 50 rpm) and the frequency is greater than a predetermined frequency threshold (for example only, 5 counts in 5 seconds), the engine is experiencing an engine roll condition.

The torque reserve determination module 420 receives signals from the idle condition module 400 communicating the idle state, including at least whether the engine is idling, presence of lean codes, and presence of engine roll or idle instability. The torque reserve determination module 420 determines whether to increase a speed control torque reserve by a step (for example, a step may be a 5 Nm increase) or increase a speed control desired engine speed by a step (for example, a step may be a 50 RPM increase) based on the signals from the idle condition module 400. The torque reserve determination module 420 sends signals communicating the request for either the increased speed control torque reserve or the increased speed control desired engine speed to the propulsion torque arbitration module 248 and driver input module 18.

The torque reserve determination module 420 determines the separation between a RPM control module immediate torque and a low limit/clamp of allowed engine immediate torque by calculating a Torque Delta 1. The Torque Delta 1 may be the difference between a RPM control module requested torque and the engine capabilities module 244 minimum torque allowed. The torque reserve determination module compares the Torque Delta 1 with a first predetermined value (for example only, 10 Newton-meters (Nm)). If the Torque Delta 1 is greater than the first predetermined value, the RPM control module immediate torque is not within a predetermined torque threshold of the low limit/clamp of allowed engine immediate torque (for example only, within approximately 10 Nm of the low limit/clamp). Conversely, if the Torque Delta 1 is not greater than the first predetermined value, the RPM control module immediate torque is within the predetermined torque threshold of the law limit/clamp of allowed engine immediate torque.

The torque reserve determination module 420 determines whether an air per cylinder (APC) is being clamped to a minimum air limit (defined by a misfire characteristic or a combustion stability/quality characteristic) by calculating an air per cylinder (APC) delta. The APC delta may be the difference between the measured APC and the minimum APC based/required on good combustion quality. The torque reserve determination module 420 then compares the APC delta with a second predetermined value (for example only, 60 milligrams (mg) of APC per cylinder event). If the APC delta is greater than the second predetermined value, then the air per cylinder is not clamped to a minimum air limit. If the APC delta is less than the second predetermined value, then the air per cylinder is clamped to a minimum air limit.

The torque reserve determination module 420 determines a range between a high and a low limit for allowed engine torque by calculating a Torque Delta 2. The Torque Delta 2 is the difference between the maximum predicted torque from the reserves/loads module 280 and the engine capabilities module 244 minimum immediate torque allowed. The torque reserve determination module 420 compares the Torque Delta 2 with a third predetermined value (for example only, 20 Nm). If the Torque Delta 2 is less than the third predetermined value, the speed control torque reserve is increased to widen the range between the low and high limit for allowed engine torque. If the Torque Delta 2 is greater than the third predetermined value, the speed control desired engine speed is increased.

If the torque reserve determination module 420 determines that the Torque Delta 1 is less than the first predetermined value, the APC Delta is less than the second predetermined value, and the Torque Delta 2 is less than the third predetermined value, the torque reserve determination module 420 will send a signal to the propulsion torque arbitration module 248 and the driver input module 18 commanding the increased speed control torque reserve. If the torque reserve determination module 420 determines that the Torque Delta 1 is less than the first predetermined value, the APC Delta is less than the second predetermined value, and the Torque Delta 2 is greater than or equal to the third predetermined value, the torque reserve determination module 420 sends a signal to the propulsion torque arbitration module 248 and the driver input module 18 commanding the increased speed control desired engine speed.

If the torque reserve determination module 420 increases the speed control torque reserve by the step, the torque reserve determination module 420 determines whether the speed control torque reserve is greater than a fourth predetermined value (for example, 30 Nm). If true, no additional changes to the speed control torque reserve or speed control desired engine speed are made. If the speed control torque reserve is less than the fourth predetermined value, the torque reserve determination module receives updated signals from the idle condition module 400 and the reserves/loads module 280 and performs the previously discussed calculations again to determine whether to increase the speed control torque reserve or the speed control desired engine speed.

If the torque reserve determination module 420 increases the speed control desired engine speed by the step, the torque reserve determination module 420 determines whether the speed control desired engine speed is greater than a fifth predetermined value (for example, 800 RPM). If true, no additional changes to the speed control torque reserve or speed control desired engine speed are made. If the speed control desired engine speed is less than the fifth predetermined value, the torque reserve determination module receives updated signals from the idle condition module 400 and the reserves/loads module 280 and performs the previously discussed calculations again to determine whether to increase the speed control torque reserve or the speed control desired engine speed.

Figure 4:
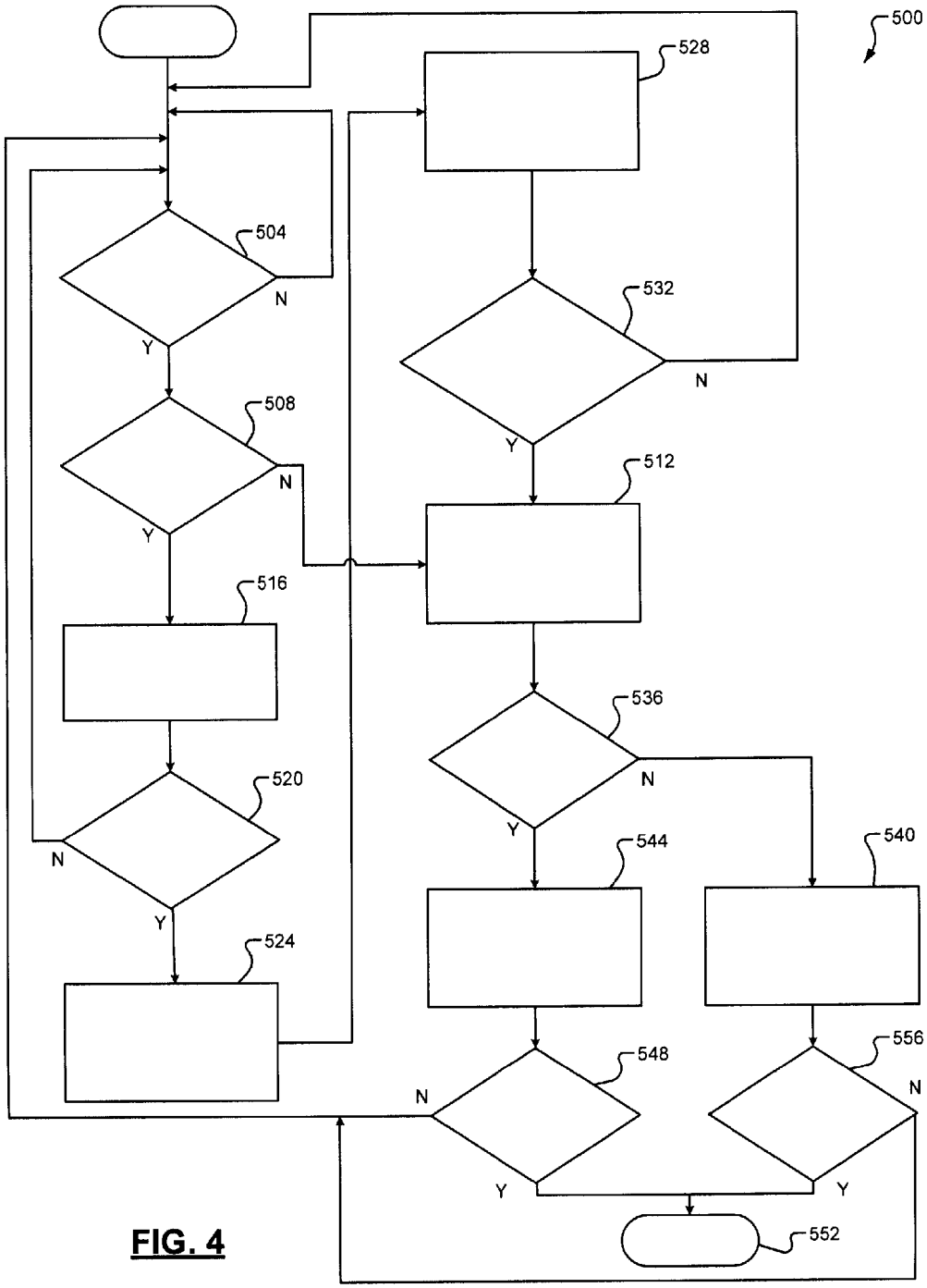
FIG. 4 illustrates an adaptive engine speed control method according to the present disclosure.

Referring now to FIG. 4, an adaptive engine speed control method 500 to prevent engine speed (RPM) roll and stall according to the present disclosure is set forth. At 504, method 500 determines whether an idle condition is met. If false, method 500 continues checking for the idle condition at 504. If true, method 500 moves to 508. At 508, the method 500 determines whether any lean diagnostic trouble codes (DTCs) have been set. If true, method 500 moves to 512 which will be discussed in more detail later. If false, method 500 calculates the engine roll score at 516. At 520, the method 500 uses the engine roll score to determine whether there is engine roll or engine speed instability. If false, the method 500 returns to 504. If true, the method moves to 524. At 524, the method 500 calculates Torque Delta 1. At 528, the method 500 calculates APC Delta. At 532, method 500 determines whether the Torque Delta 1 is less than the first predetermined value and whether the APC Delta is less than the second predetermined value. If false, method 500 returns to 504 and checks for an idle condition. If true, method 500 moves to 512. At 512, method 500 calculates Torque Delta 2. At 536, method 500 determines whether the Torque Delta 2 is less than the third predetermined value. If false, the method 500 increases the desired engine speed (RPM) by a step (for example, 50 RPM) at 540. If true, the method 500 increases the torque reserve by a step (for example, 5 Nm) at 544.

At 548, method 500 determines whether the torque reserve is greater than the fourth predetermined value. If true, method 500 ends at 552. If false, method 500 returns to 504. At 556, method 500 determines whether the desired engine speed is greater than the fifth predetermined value. If true, method 500 ends at 552. If false, method 500 returns to 504.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be partially or fully implemented by one or more computer programs executed by one or more processors. The computer programs include processor-executable instructions that are stored on at least one non-transitory tangible computer readable medium. The computer programs may also include and/or rely on stored data. Non-limiting examples of the non-transitory tangible computer readable medium include nonvolatile memory, volatile memory, magnetic storage, and optical storage.

What is claimed is:

1. An adaptive engine speed control system comprising:

an idle condition module that determines whether the engine is idling, determines an engine speed error based on a difference between an actual engine speed and a desired engine speed, wherein the desired engine speed corresponds to a commanded engine speed, determines an engine speed error frequency based on a number of times the engine speed error occurs within a predetermined period, and detects an engine roll condition based on the engine speed error and the engine speed error frequency; and a torque reserve determination module that adjusts at least one of a torque reserve and the desired engine speed based on the determination of whether the engine is idling and the detected engine roll condition, wherein the tourque reserve corresponds to a quality of tourque reserved to an anticipated future load on the engine.

2. The system of claim 1, wherein the torque reserve determination module increases the torque reserve if a separation between a requested immediate torque and a minimum allowed immediate torque is less than a first predetermined value, a separation between a current air per cylinder and a minimum air per cylinder limit is less than a second predetermined value, and an allowed torque range is less than a third predetermined value.

3. The system of claim 1, wherein the torque reserve determination module increases the desired engine speed if a separation between a requested immediate torque and a minimum allowed immediate torque is less than a first predetermined value, a separation between a current air per cylinder and a minimum air per cylinder limit is less than a second predetermined value, and an allowed torque range is not less than a third predetermined value.

4. The system of claim 1, wherein the idle condition module determines whether the engine is idling based on a driver input characteristic that is at least one of an engine speed, a vehicle speed, a pedal position, and a throttle position.

5. The system of claim 1, wherein the idle condition module determines a diagnostic trouble code indicating a lean state of the engine.

6. The system of claim 1, wherein the engine roll condition occurs if the engine speed oscillates with an engine speed error greater than an error threshold and a frequency of error oscillation greater than a frequency threshold.

7. The system of claim 1, wherein the engine is idling if at least one of a pedal position is less than a pedal position threshold, a vehicle speed is less than a vehicle speed threshold, an engine speed is less than an engine speed threshold, and a throttle position is less than a throttle position threshold, is true.

8. An adaptive engine speed control method comprising:

determining whether the engine is idling;

determining an engine speed error based on a difference between an actual engine speed and a desired engine speed, wherein the desired engine speed corresponds to a commanded engine speed;

determining an engine speed error frequency based on a number of times the engine speed error occurs within a predetermined period;

detecting an engine roll condition based on the engine speed error and the engine speed error frequency; and adjusting at least one of a torque reserve and the desired engine speed based on the determination of whether the engine is idling and the detected engine roll condition wherein the torque reserve corresponds to a quantity of torque reserved to respond to an anticipated future load on the engine.

9. The method of claim 8, wherein the torque reserve is increased if a separation between a requested immediate torque and a minimum allowed immediate torque is less than a first predetermined value, a separation between a current air per cylinder and a minimum air per cylinder limit is less than a second predetermined value, and an allowed torque range is less than a third predetermined value.

10. The method of claim 8, wherein the desired engine speed is increased if a separation between a requested immediate torque and a minimum allowed immediate torque is less than a first predetermined value, a separation between a current air per cylinder and a minimum air per cylinder limit is less than a second predetermined value, and an allowed torque range is not less than a third predetermined value.

11. The method of claim 8, wherein the determination of whether the engine is idling is based on a driver input characteristic that is at least one of an engine speed, a vehicle speed, a pedal position, and a throttle position.

12. The method of claim 8, further comprising determining a diagnostic trouble code indicating a lean state of the engine.

13. The method of claim 8, wherein the engine roll condition occurs if the engine speed oscillates with an engine speed error greater than an error threshold and a frequency of error oscillation greater than a frequency threshold.

14. The method of claim 8, wherein the engine is idling if at least one of a pedal position is less than a pedal position threshold, a vehicle speed is less than a vehicle speed threshold, an engine speed is less than an engine speed threshold, and a throttle position is less than a throttle position threshold, is true.

* * * * *